US009739580B1

(12) United States Patent
Gibbons, III et al.

(10) Patent No.: US 9,739,580 B1
(45) Date of Patent: Aug. 22, 2017

(54) AMMUNITION CARTRIDGE

(71) Applicants: Gould Gibbons, III, Westminster, MD (US); Ronald Sebeck, Jr., Westminster, MD (US); Andrew Gibbons, Westminster, MD (US); Matthew Gibbons, Westminster, MD (US)

(72) Inventors: Gould Gibbons, III, Westminster, MD (US); Ronald Sebeck, Jr., Westminster, MD (US); Andrew Gibbons, Westminster, MD (US); Matthew Gibbons, Westminster, MD (US)

( * ) Notice: Subject to any disclaimer, the term of this patent is extended or adjusted under 35 U.S.C. 154(b) by 0 days.

(21) Appl. No.: 15/048,105

(22) Filed: Feb. 19, 2016

(51) Int. Cl.
*F42B 5/02* (2006.01)
*F42B 5/26* (2006.01)

(52) U.S. Cl.
CPC ..... *F42B 5/02* (2013.01); *F42B 5/025* (2013.01); *F42B 5/26* (2013.01)

(58) Field of Classification Search
CPC .... F42B 5/02; F42B 5/025; F42B 5/26; F42B 5/28; F42B 5/30
USPC ..... 102/439, 464–470
See application file for complete search history.

(56) References Cited

U.S. PATENT DOCUMENTS

| | | | | |
|---|---|---|---|---|
| 2,269,316 | A | 1/1942 | O'Neil | |
| 5,033,386 | A | 7/1991 | Vatsvog | |
| 5,275,108 | A | 1/1994 | Chernicky et al. | |
| 5,463,959 | A | 11/1995 | Kramer | |
| 5,970,879 | A | 10/1999 | Jamison | |
| 6,532,876 | B1 | 3/2003 | Ramirez et al. | |
| 6,679,150 | B1 | 1/2004 | Ramirez et al. | |
| 7,210,260 | B1 | 5/2007 | Smalley, Jr. et al. | |
| 7,316,093 | B2 * | 1/2008 | Kightlinger | F42B 5/025 102/430 |
| 8,011,301 | B1 | 9/2011 | Sloan | |
| 8,689,696 | B1 | 4/2014 | Seeman et al. | |
| 8,695,260 | B2 * | 4/2014 | Kramer | F41A 5/18 42/69.02 |
| 8,850,732 | B2 * | 10/2014 | Zheng | F41A 9/70 42/49.02 |
| 9,121,614 | B2 * | 9/2015 | Kramer | F41A 5/18 |
| 9,404,719 | B1 * | 8/2016 | Bowers | F42B 5/025 |
| 2011/0214583 | A1 * | 9/2011 | Dutch | F42B 5/025 102/464 |

(Continued)

OTHER PUBLICATIONS

The RCBS.Load Cartridge Designer Utility, published on the internet Apr. 31, 2001; http://www.gmdr.com/rcbs/rcbstext9.htm.*

*Primary Examiner* — James S Bergin
(74) *Attorney, Agent, or Firm* — Rosenberg, Klein & Lee

(57) ABSTRACT

Ammunition cartridges for hunting big game with an AR15 rifle are provided while maintaining a size of the ammunition cartridge that permits multiple ammunition cartridges to be inserted into an AR15 rifle magazine in alternating side by side relation. Each cartridge has a rim diameter of 0.422 inches, extractor groove and a slight tapered main body base of 0.36°. In one embodiment, the main base body extends to form a cartridge with total length of 1.8 inches and nominal body taper of 0.020 inches to accept a bullet with a diameter of 0.400 inches. In other embodiments, the main body base extends to a shoulder and a neck to form a cartridge with a total length of 1.66 inches. The shoulder tapers to the neck at a 35° angle with a nominal body taper of 0.014 inches. These embodiments accept bullets with diameters of 0.277, 0.284 and 0.308 inches.

16 Claims, 3 Drawing Sheets

(56) References Cited

U.S. PATENT DOCUMENTS

| | | | | |
|---|---|---|---|---|
| 2012/0180689 | A1* | 7/2012 | Schuster | F42B 5/025 102/469 |
| 2014/0318404 | A1* | 10/2014 | Kerley | F42B 5/025 102/469 |
| 2016/0223303 | A1* | 8/2016 | Sloan | F42B 10/38 |

* cited by examiner

AMMUNITION CARTRIDGE

FIELD OF THE INVENTION

The subject system generally relates to the field of ammunition for firearms. Further, the subject concept is directed to the field of ammunition cartridges which may be used for varying bullet calibers in a variety of scenarios, but in particular, is useful for big game hunting. Still further, the subject concept is directed to the field of adapting and fabricating ammunition cartridges which accept differing bullet calibers. Still further, this concept is directed to the field of big game hunting which is adapted to a wide range of rifles and in particular, to ammunition cartridges for an AR15 type rifle, such as the AR15 rifle, the M16 rifle and other variants.

Still further, this concept is directed to the area of providing an ammunition cartridge which may be sized to allow alternate side-by-side stacking of the cartridge in a standard AR15 type rifle magazine or other rifle magazine having substantially the same dimensions as an AR15 type rifle magazine. Still further, this concept is directed to the field of providing ammunition cartridges which are adaptable to a selected group of bullets having particular caliber and weight which increases the firepower of a firearm to provide impact energy greater than that known in the prior art for particular firearms, while maintaining the ability to have a standard magazine accept the combination of ammunition cartridges in a side-by-side alternating manner.

Still further, the subject matter of the subject ammunition cartridge is directed to the area of reducing the overall length of an ammunition cartridge for acceptance into a standard AR15 type rifle magazine while maintaining the acceptable impact energy and muzzle energy acceptable for big game hunting.

SUMMARY OF THE INVENTION

There is provided an ammunition cartridge which includes an annularly contoured rim section defining an axis line and having an outer diameter of 0.422 inches (within manufacturing tolerance ranges). The annularly contoured rim section has two opposing ends, namely, first and second ends with the first end of the annularly contoured rim section adapted to receive a standard small or large rifle primer. An extractor groove is formed adjacent the rim second end and the extractor groove has an outer diameter less than the outer diameter of the annularly contoured rim section.

A hollow main body section is adapted to receive a powder charge where the main body section is symmetrically contoured about the axis line and extends in the axis line direction from the extractor groove and has a main body first end which is next to or adjacent to the extractor groove. An opposing main body second end is adapted to receive a particular caliber bullet with the hollow main body section contoured to taper inwardly toward the axis line from the rim section throughout at least a portion of the length of the hollow main body at an angle of 0.36° (within manufacturing tolerance ranges).

It is an object of the present invention to provide an improved ammunition cartridge for a firearm.

It is another object of the subject invention to provide an improved ammunition cartridge, particularly sized and dimensioned to be accepted in an AR15 type rifle.

It is a further object of the invention to provide an improved ammunition cartridge for an AR15 type rifle, which provides increased muzzle energy without substantially increasing the size and overall length of the ammunition cartridge.

Still further, it is an object of the invention to provide an improved ammunition cartridge for an AR15 type rifle which has high durability.

A still further object of the invention is to provide an improved ammunition cartridge for an AR15 type rifle that improves projectile or bullet energy over extended ranges.

It is a further object of the subject invention to provide an ammunition cartridge which may be used in combination with a plurality of cartridges to be inserted into a standard AR15 type rifle magazine.

It is a further object of the subject invention to provide an ammunition cartridge which may be stacked in an alternating side-by-side relation to maintain the standard capacity of a standard AR15 type rifle magazine.

It is a further object of the subject invention to provide an improved ammunition cartridge which is sized in a manner to increase the powder charge volume of an ammunition cartridge to provide increased muzzle energy and impact energy.

A further object of the subject invention is to provide an ammunition cartridge which permits the standard AR15 type rifle to be used in big game hunting.

A further object of the invention is to utilize an existing AR-15 bolt variant that is commercially available. Currently, AR-15 type rifles utilize bolts that accommodate ammunition cartridges with rim diameters of 0.378 inches, 0.422 inches, 0.445 inches and 0.473 inches. As the bolt face is made larger to accommodate ammunition cartridges with larger rim diameters, the locking lugs become progressively weaker. The inventors have chosen to use the AR-15 bolt that accommodates an ammunition cartridge with a 0.422 inch rim diameter. It is a known fact that the locking lugs on AR-15 type bolts fatigue over time and will eventually fail. By utilizing the 0.422 inch rim diameter the inventors have developed an ammunition cartridge to be used with known bolts for the AR-15 that enhances balance between bolt durability and ammunition performance.

PRIOR ART

Numerous ammunition cartridges are known in the art. An example of a prior art cartridge is the standard cartridge known as the 5.56 NATO/.223. An acceptable hunting load for this cartridge would be a 60 grain jacketed soft point bullet having a 0.224 inch diameter. At a muzzle velocity of 3125 fps, this configuration yields a 1300 foot pound force at the muzzle, but the energy drops off to 973 foot pounds at 100 yards and 514 foot pounds at 300 yards.

When a prior art cartridge, such as the 5.56 NATO/.223 cartridge, is adapted to have a larger neck or "necked up" to accept a larger bullet, the powder charge is reduced. However, this trade-off does not yield higher impact energy at the target.

In the many ammunition cartridges available, options are provided where the ammunition cartridge may be increased in size and dimension to accept a larger diameter bullet with a powder charge. Increasing the size of the cartridge decreases the amount of ammunition cartridges that may be loaded into a magazine due to the fact that larger diameter ammunition cartridge can no longer be double-stacked in an alternating side-by-side manner in AR-15 rifle magazines. The concept of alternating side-by-side stacking of ammunition cartridges into a standard magazine, maintains the maximum efficiency of the original AR-15 magazine design. Ammunition cartridges with rim and base diameters greater than 450 inches do not reliably double stack in a standard AR-15 magazine.

Other prior art ammunition cartridges used in big game hunting scenarios generally have a longer overall length, which are not adaptable to an AR15 type rifle.

DESCRIPTION OF THE PREFERRED EMBODIMENTS

Figure 1:
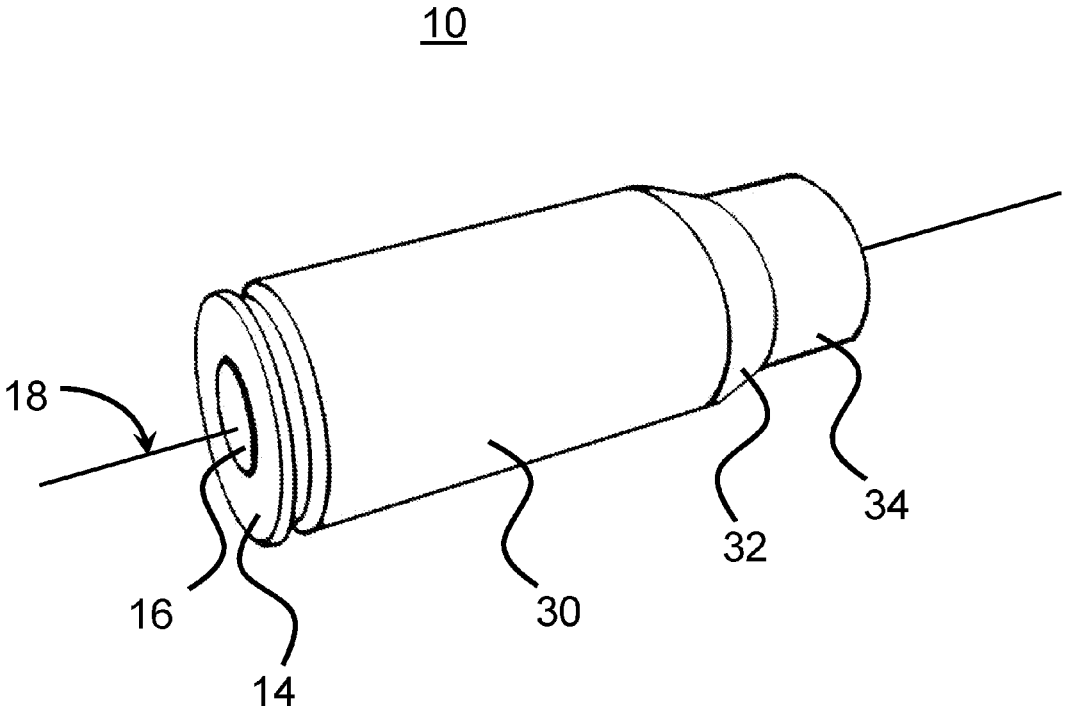
FIG. 1 is a perspective view of the ammunition cartridge of the subject concept.
Figure 2:
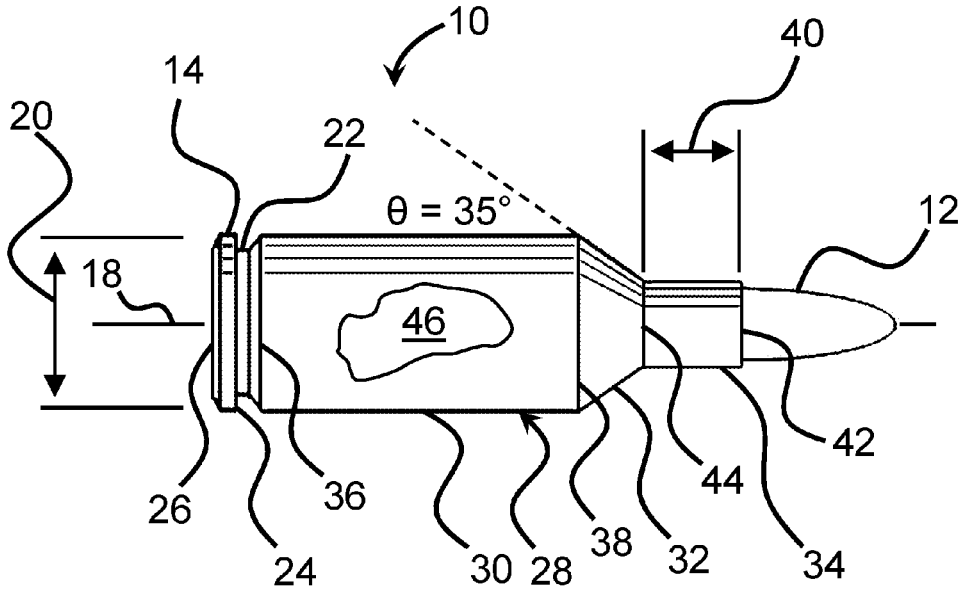
FIG. 2 is an elevational view of the subject ammunition cartridge including in combination the bullet inserted therein.
Figure 4:
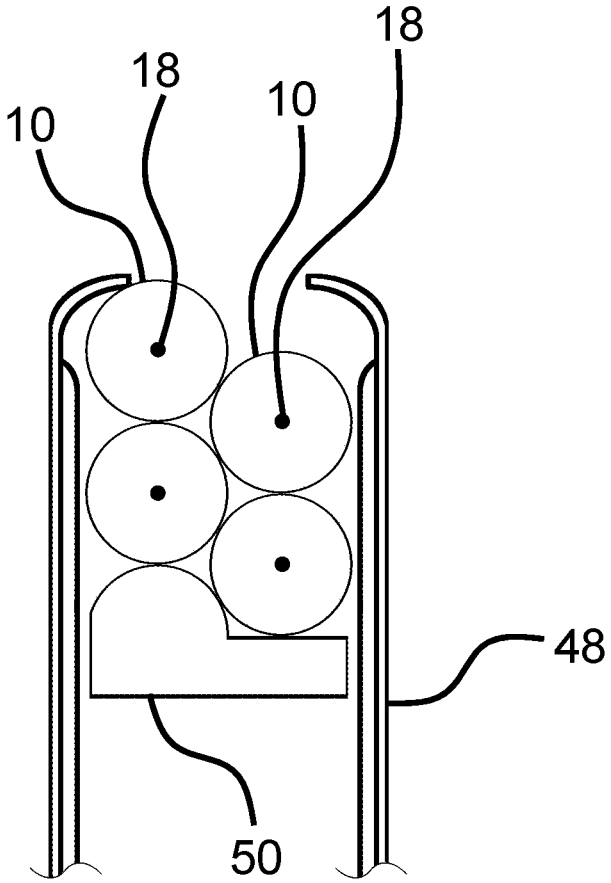

Referring now to FIGS. 1-2 and 4, there is provided an ammunition cartridge 10 to accommodate insertion thereof of a bullet 12 to be used in conjunction with a hunting rifle. The subject ammunition cartridge 10 is adaptable for insertion of bullets 12 of varying calibers, however, the most common calibers being used for big game hunting generally are 270, 280, and 300. In addition, the subject ammunition cartridge can use a 0.40 in/10 mm caliber bullet. The aforementioned calibers are commonly referred as .270, 7 mm, .30 and .40 caliber. Although useful for big game hunting, ammunition cartridge 10 may be used in a variety of hunting arenas. In general, big game hunting is directed to large animals sought and harvested by hunters and although the term "big game" is not well-defined, it is generally accepted in North America as referring to deer, antelope, sheep, black bears, and elk, among other large animals. Differing regions have particular statutes and regulations requiring minimum calibers and minimum bullet energies at the muzzle for rifles and handguns used for big game hunting. In general, an acceptable big game hunting ammunition cartridge should develop 1200-1500 foot pounds of energy at the intended target, at any given range.

One of the problems associated with hunting big game with AR-15-type rifles, is that the bullets 12 do not have sufficient muzzle energy or sufficient impact energy at the intended target. Thus, most prior art ammunition cartridge variants for the AR-15-type rifles have not been capable of producing the aforementioned 1200-1500 foot pounds of energy at the intended target.

The subject ammunition cartridge 10 has been developed to accommodate a standard caliber bullet while providing sufficient powder charge that the impact energy and muzzle energy is sufficient to meet preferred standards for big game hunting. The problem associated with the use of AR15-type rifles for big game hunting is the fact that prior art ammunition cartridges and their inserted bullets do not generally provide for sufficient muzzle and impact energy at the intended target at any given range. Still further, when standard ammunition cartridges with a base and rim diameter greater than 0.450 inches are used, they are not able to be reliably inserted into a standard AR15 type rifle magazine in an alternating side-by-side relation. As will be seen in following paragraphs, the particular contouring and sizing of the subject ammunition cartridge 10 obviates the disadvantages associated with prior ammunition cartridges now in use.

Figure 3:
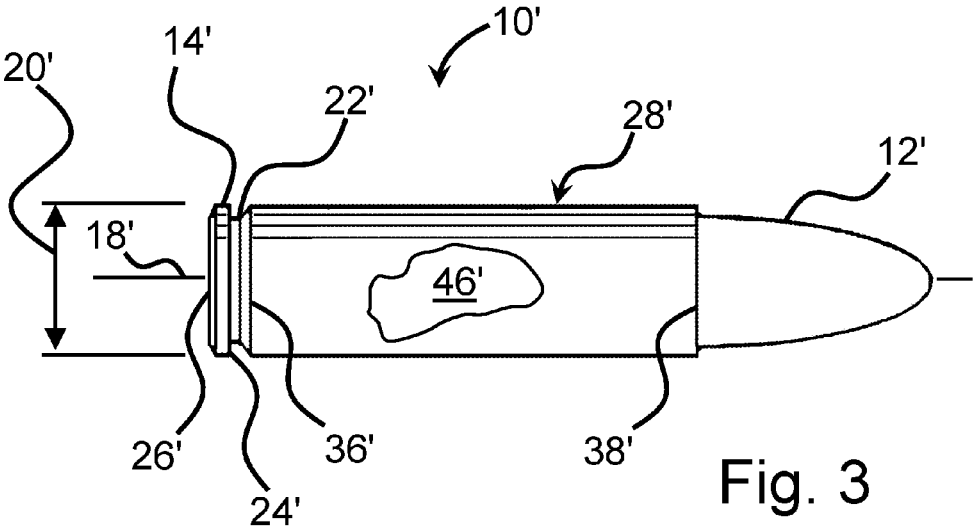
FIG. 3 is an elevational view of an embodiment of the subject ammunition cartridge; and, FIG. 4 is a schematic elevational view of a plurality of cartridges mounted in a standard firearm magazine permitting side-by-side alternating positioning.

Referring once again to FIGS. 1 and 2, FIG. 1 shows the ammunition cartridge 10 and FIG. 2 shows the ammunition cartridge 10 having inserted therein bullet 12. Ammunition cartridge 10 includes annularly contoured rim section 14 adapted to have a primer 16 inserted therein. The overall configuration of ammunition cartridge 10 is circular in cross-section, as is common in the art. Annularly contoured rim section 14 is developed about axis line 18, as is seen in FIGS. 1-3. Annular rim section 14 has an outer diameter of 0.422 inches (within manufacturing tolerance ranges).

An extractor groove 22 is formed adjacent to rim second end 24 which is opposite annular rim section first end 26, as is seen in the Figures. Extractor groove 22 has a diameter less than the outer diameter of annular rim section 14. For purposes of the subject ammunition cartridge 10, the extractor groove 22 includes a diameter with respect to axis line 18 of 0.350 inches (within manufacturing tolerance ranges). Formed in one-piece formation to annular rim section 14 is hollow main body section 28 which is comprised of a main body first section 30, a shoulder section 32, and a neck section 34. Hollow main body section 28 is adapted to receive a powder charge and the hollow main body section 28 is formed about the axis line 18 in a symmetrical manner. Hollow main body section 28 extends in the direction of axis line 18 from the extractor groove 22. Hollow main body section 28 includes main body section first end 36 adjacent and formed in one-piece formation with extractor groove 22 and annular rim section 14, and has an opposing main body section second end 38 from the main body section first end 36 toward main body section second end 38 tapered at an angle of 0.36° with a nominal body taper of 0.014 inch taper (all within manufacturing tolerance ranges). Main body second section end 38 has a diameter of 0.434 inches resulting in the 0.014 inch tapering at the tapering angle of 0.36°.

Main body first section 30 terminates in main body section second end 38 and is formed in one-piece formation with shoulder section 32. Shoulder section 32 is tapered at a 35° angle with respect to axis line 18, as is seen in FIG. 2. Shoulder section 32 tapers to be formed in one-piece formation with neck section 34 having a diameter ranging between 0.307 inches and 0.338 inches dependent upon the caliber size of bullet 12. In general, for a 270 caliber bullet, the neck diameter is 0.307, for a bullet caliber of 280, the neck diameter is 0.314 inches, and for a 300 caliber bullet, the neck diameter is 0.338 inches (all within manufacturing tolerance ranges). The length of neck section 34 ranges between 0.28 inches-0.302 inches, dependent upon the bullet 12 caliber. The overall criteria is that the length of ammunition cartridge 10 from annular rim section first end 26 to neck second end 42 be maintained at a length of 1.66 inches. Thus, for differing caliber bullets, the sizing and dimensions of the neck section 34 and shoulder section 32 will be selected, dependent upon the bullet caliber being 270, 280, or 300.

Thus, it is seen in FIGS. 1 and 2 that ammunition cartridge 10 comprises distinct section areas including annular rim section 14, hollow main body section 28 comprised of main body first section 30, shoulder section 32, and neck section 34.

By providing a taper angle of 35° for the shoulder section 32, there is provided an increased charge chamber volume to accommodate a larger powder charge. Additionally, for standard caliber bullets 270, 280, and 300, the diameter of main body first section is tapered from a maximum of 0.448 inches at main body section first end 36 to a diameter of 0.434 inches developed at main body section second end 38.

In this manner, as is seen in FIG. 4, a plurality of ammunition cartridges 10 may be inserted into a standard AR15 type rifle magazine 48. Follower 50, which is generally spring-loaded, biases the ammunition cartridges 10 to an upper section, as seen. With the particular novel dimensioning and the rising of ammunition cartridge 10, cartridges 10 can be mounted in alternating side-by-side relation to provide the user with additional rounds in keeping with that which is known in the prior art.

The neck diameter of ammunition cartridge 10 is governed by a desired bullet diameter. Given a desired bullet diameter, the applicant has found that the length of the shoulder section 32 in relation to the overall length of the cartridge 10 is governed by the equation:

$$L_s = \frac{S_r - N_r}{\tan\theta_s} \quad (1)$$

where $L_s$ is the length of the shoulder section 32 in inches between main body section 38 and neck end 42, $S_r$ is the radius of the cartridge 10 in inches at main body section 38 where the main body section 38 of the cartridge 10 meets the shoulder section 32, $N_r$ is the radius of the neck section 34 in inches and $\theta_s$ is the shoulder angle in degrees.

With the overall length of the cartridge 10, $L_c$, being 1.66 inches, the length of the neck section 34, $L_n$, is determined by subtracting the base length of the cartridge 10 from the rim section 14 to the shoulder section 32, $L_b$, and the length of the shoulder section 32, $L_s$, from the overall length of the cartridge 10, $L_c$, wherein $L_n$ is:

$$L_n = L_c - L_b - L_s. \quad (2)$$

The general dimensions of ammunition cartridge 10 as fabricated are shown in Table 1 for differing bullet calibers.

TABLE 1

| | Cartridge | | | | | |
|---|---|---|---|---|---|---|
| | 270 | | 280 | | 300 | |
| | in. | mm | in. | mm | in. | mm |
| Bullet Diameter | 0.277 | 7.0358 | 0.284 | 7.2136 | 0.308 | 7.8232 |
| Rim Diameter | 0.422 | 10.71 | 0.422 | 10.71 | 0.422 | 10.71 |
| Base Diameter | 0.448 | 11.3792 | 0.448 | 11.3792 | 0.448 | 11.3792 |
| Neck Base Diameter | 0.307 | 7.7978 | 0.314 | 7.9756 | 0.338 | 8.5852 |
| Rim to Base | 0.2 | 5.08 | 0.2 | 5.08 | 0.2 | 5.08 |
| Shoulder Angle | 35 degrees | | 35 degrees | | 35 degrees | |
| Rim to Shoulder | 1.3 | 33.02 | 1.3 | 33.02 | 1.3 | 33.02 |
| Base to Shoulder | 1.1 | 27.94 | 1.1 | 27.94 | 1.1 | 27.94 |
| Overall Case Length | 1.66 | 42.164 | 1.66 | 42.164 | 1.66 | 42.164 |
| Headspace Measurement | 1.36 | 34.544 | 1.36 | 34.544 | 1.36 | 34.544 |
| Neck Diameter | 0.307 | 7.7978 | 0.314 | 7.9756 | 0.338 | 8.5852 |
| Neck Length | 0.28 | 7.112 | 0.285 | 7.239 | 0.302 | 7.6708 |
| Rim Thickness | 0.05 | 1.27 | 0.05 | 1.27 | 0.05 | 1.27 |
| Extractor Groove Width | 0.039 | 0.9906 | 0.039 | 0.9906 | 0.039 | 0.9906 |
| Extractor Groove Diameter | 0.350 | 8.89 | 0.350 | 8.89 | 0.350 | 8.89 |
| Body Taper | 0.014 | 0.3556 | 0.014 | 0.3556 | 0.014 | 0.3556 |
| Shoulder Base Diameter | 0.434 | 11.0236 | 0.434 | 11.0236 | 0.434 | 11.0236 |
| Shoulder length | 0.09 | 2.286 | 0.085 | 2.159 | 0.068 | 1.7272 |

Referring now to FIG. 3, there is shown an embodiment of the subject system and concept. Ammunition cartridge 10' includes annularly contoured rim section 14' which is circular in cross-sectional contour and is formed symmetrically about axis line 18'. Annularly contoured rim section 14' has an outer diameter of 0.422 inches (within manufacturing tolerance ranges) and includes opposing first and second ends 24' and 26'. Annular rim section 14' is separated from hollow main body section 28' by extractor groove section 22'. It is to be understood that annular rim section 14' and hollow main body section 28' are formed in one-piece formation. Hollow main body section 28' includes charge chamber 46'. Annularly contoured rim section 14' having the opposing first and second ends 24' and 26' is adapted to receive a primer, as was provided for the preferred embodiment discussed.

The extractor groove 22' is seen to be formed adjacent rim section 14' second end 24' with the extractor groove having an outer diameter less than the outer diameter of the annularly contoured rim section 14'. The extractor groove 22' has a diameter of 0.350 inches (within manufacturing tolerance ranges) as opposed to the 0.422 inches of the diameter of the rim 14'.

The hollow main body section 28' is adapted to receive a powder charge within charge chamber 46' and hollow main body section 28' is symmetrically formed about axis line 18' to provide a cross-sectional circular contour throughout the length of hollow main body section 28'. Hollow main body section 28' extends from hollow main body section first end 36' to main body section second end 38' in the direction of axis line 18'. The main body section second end 38' is adapted to receive a predetermined caliber size bullet 12' with the hollow main body section 28' contoured to taper toward the axis line 18' from the main body section first end 36' to main body section second end 38'. The taper formed by hollow main body section 28' is at an angle of 0.36° with a nominal body tapering of 0.020 inch taper (all within manufacturing tolerance ranges) and provides for a diminishing diameter from 0.448 inches to 0.428 inches in diameter for receipt of a 0.40/10 mm caliber bullet 12'. The combined length in axis line direction 18' of main body section 28', in combination with the extractor groove 22' and the rim section 14' is 1.8 inches within manufacturing tolerance ranges and results in an external diameter of main body second section end 38' having a diameter of 0.428 inches (within manufacturing tolerance ranges).

Hollow main body 28' is tapered throughout the length of main body 28' at an angle of 0.36° with a nominal body tapering of 0.020 inch taper. Thus, hollow main body section 28' tapers from a diameter of 0.448 inches to 0.428 inches (within manufacturing tolerance ranges). Thus, hollow main body 28' is adapted to receive bullet 12' having a 0.40/10 mm caliber, while simultaneously maintaining the overall length of ammunition cartridge 10' at 1.8 inches (within manufacturing tolerance ranges). In this manner, ammunition cartridge 10' is adapted to be received within a standard AR15 type rifle magazine 48, as is shown in FIG. 4, while simultaneously permitting the insert of a plurality of cartridges 10' in an alternating side-by-side relation with respect to a plurality of cartridges 10' inserted into the rifle magazine 48.

The general dimensions of ammunition cartridge 10' as fabricated are shown in Table 2 for a 0.40/10 mm caliber bullet.

TABLE 2

| | Cartridge | |
|---|---|---|
| | 400 in. | mm |
| Bullet Diameter | 0.400 | 10.16 |
| Rim Diameter | 0.422 | 10.7188 |
| Base Diameter | 0.448 | 11.3792 |
| Bullet Receiving End Diameter | 0.428 | 10.8712 |
| Rim to Base | 0.2 | 5.08 |
| Base to Bullet Receiving End | 1.6 | 40.64 |
| Overall Case Length | 1.8 | 45.72 |
| Headspace Measurement | 1.8 | 45.72 |
| Rim Thickness | 0.050 | 1.27 |
| Extractor Groove Width | 0.039 | 0.9906 |
| Extractor Groove Diameter | 0.350 | 8.89 |
| Body Taper | 0.020 | 0.508 |

Table 3 shows the enhanced energy of the new ammunition cartridges compared to the 5.56 NATO/.223 ammunition cartridge demonstrating the expressed purposes of the inventive concepts described herein.

TABLE 3

Comparison of the enhanced energies in foot pounds of the Prior Art .223/5.56 cartridge vs. cartridges of inventive concept

| | Cartridge | | | | |
|---|---|---|---|---|---|
| | .223/5.56 60 gr | .270 130 gr | .280 140 gr | .300 165 gr | .400 200 gr |
| Muzzle energy | 1300 | 2104 | 2182 | 2382 | 2742 |
| 100 yards | 973 | 1783 | 1864 | 2002 | 2085 |
| 200 yards | 715 | 1503 | 1551 | 1672 | 1557 |
| 300 yards | 514 | 1257 | 1294 | 1385 | 1151 |
| 400 yards | 362 | 1044 | 1073 | 1142 | 844 |
| 500 yards | 250 | 862 | 885 | 936 | 630 |

Although this invention has been described in connection with specific forms and embodiments thereof, it will be appreciated that various modifications other than those discussed above may be resorted to without departing from the spirit or scope of the invention as defined in the appended claims. For example, functionally equivalent elements may be substituted for those specifically shown and described, certain features may be used independently of other features, and in certain cases, particular locations of elements, steps, or processes may be reversed or interposed, all without departing from the spirit or scope of the invention as defined in the appended claims. It is also to be understood that all dimensions and angles specified in the Specification and Claims are to be understood to be within manufacturing tolerances.

What is claimed is:

1. An ammunition cartridge comprising:

an annularly contoured rim section defining an axis line and having an outer diameter of 0.422 inches, said annularly contoured rim section having opposing first and second ends, said first end adapted to receive a primer;

an extractor groove formed adjacent said rim section second end, said extractor groove having an outer diameter less than said outer diameter of said annularly contoured rim section; and, a hollow main body section adapted to receive a powder charge formed symmetrically about said axis line and extending in said axis line direction from said extractor groove and having a main body section first end adjacent said extractor groove and an opposing main body section second end adapted to receive a predetermined caliber bullet, said hollow main body section being contoured to taper inwardly from an external base diameter of 0.448 inches toward said axis line from said main body section first end throughout at least a portion of the length of said hollow main body at an angle of 0.36°.

2. The ammunition cartridge as recited in claim 1 where said main body section includes:

a main body first section tapered at an angle of 0.36° from said main body section first end to a second end of said main body first section;

a shoulder section formed in one piece formation to said main body first section second end, said shoulder section being tapered at a 35° angle with respect to said axis line; and, a neck section formed in one piece formation with said main body first section and said shoulder section.

3. The ammunition cartridge as recited in claim 2 where said combined length of said annular rim section, said main body first section, said shoulder section and said neck section has an overall length of 1.66 inches.

4. The ammunition cartridge as recited in claim 3 where said neck section is adapted to receive said predetermined caliber bullet is selected from the group of .270 caliber, .280 caliber, or .300 caliber.

5. The ammunition cartridge as recited in claim 3 where said neck section has a neck diameter of 0.307 inches adapted to receive said bullet having a diameter of 0.277 inches corresponding to a 270 caliber bullet.

6. The ammunition cartridge as recited in claim 3 where said neck section has a neck diameter of 0.314 inches adapted to receive said bullet having a diameter of 0.284 inches corresponding to a 280 caliber bullet.

7. The ammunition cartridge as recited in claim 3 where said neck section has a neck diameter of 0.388 inches adapted to receive said bullet having a diameter of 0.308 inches corresponding to a 300 caliber bullet.

8. The ammunition cartridge as recited in claim 3 wherein said ammunition cartridge is adapted to be inserted into an AR15 type rifle magazine with at least one additional of said ammunition cartridge forming a plurality of ammunition cartridges.

9. The ammunition cartridge as recited in claim 8 wherein said ammunition cartridge is adapted to be inserted into said AR15 type rifle magazine in alternating side by side relation to a plurality of said ammunition cartridges inserted into said AR15 type rifle magazine.

10. The ammunition cartridge as recited in claim 1, where said combined length in said axis line direction of said main body section, said extractor groove and said rim section is 1.8 inches wherein said main body section second end has an external diameter of 0.428 inches adapted to receive said bullet having a diameter of 0.40 inches/10 mm corresponding to a 400 caliber bullet.

11. The ammunition cartridge as recited in claim 10 where said hollow main body section is tapered throughout the length of said main body.

12. The ammunition cartridge as recited in claim 11 where said hollow main body section tapers from the external base diameter of 0.448 inches at said first end to said diameter of 0.428 inches at said second end.

13. The ammunition cartridge as recited in claim 1 where said main body section is adapted to receive said bullet having a 0.40 inch/10 mm diameter.

14. The ammunition cartridge as recited in claim 1 where the overall length of said rim section, said main body section and said groove section along said axis line is 1.8 inches.

15. The ammunition cartridge as recited in claim 14 where said ammunition cartridge is adapted to be received within an AR15 type rifle magazine.

16. The ammunition cartridge as recited in claim 15 wherein said ammunition cartridge is adapted to be inserted into said AR15 type rifle magazine in alternating side by side relation to a plurality of said ammunition cartridges inserted into said AR15 type rifle magazine.

* * * * *